United States Patent [19]

Janke

[11] 4,131,996

[45] Jan. 2, 1979

[54] BLADE FOR CUTTING WALLBOARD

[76] Inventor: William R. Janke, Rte. #3, Northfield, Minn. 55057

[21] Appl. No.: 810,624

[22] Filed: Jun. 27, 1977

[51] Int. Cl.[2] ..... B26B 7/00

[52] U.S. Cl. ..... 30/273; 30/366; 30/392

[58] Field of Search ..... 30/392, 393, 394, 358, 30/362, 366, 273; 83/925 CC

[56] References Cited

U.S. PATENT DOCUMENTS

| | | | |
|---|---|---|---|
| 1,955,350 | 4/1934 | Sweet | 30/273 |
| 2,239,291 | 4/1941 | Martin | 30/273 |
| 3,033,251 | 5/1962 | Atkinson | 30/392 X |
| 3,436,824 | 4/1969 | Huston | 30/273 |
| 3,572,202 | 3/1971 | Gerber | 83/925 CC |

*Primary Examiner*—Jimmy C. Peters

*Attorney, Agent, or Firm*—Stuart R. Peterson

[57] ABSTRACT

A blade having a chisel point at one end and a cutting point intermediate its ends is mounted in the blade holder of a sabre saw. As the sabre saw is moved along the wallboard to be cut, the chisel point on each stroke moves through the gypsum core, its rearwardly inclined end forcing the gypsum back into the kerf. The chisel point need only fracture the paper on the rough side of the wallboard, although it may pass completely therethrough. The cutting point severs the paper on the finished side of the wallboard.

14 Claims, 4 Drawing Figures

BLADE FOR CUTTING WALLBOARD

BACKGROUND OF THE INVENTION

1. Field of the Invention

This invention relates generally to the cutting of wallboard, and pertains more particularly to a specially configured blade that is mounted for reciprocation by a sabre saw.

2. Description of the Prior Art

Wallboard is usually cut with a hand-held knife or a hand-held saw. Professional installers of wallboard usually utilize a knife because of the proficiency developed over a period of time, whereas carpenters and handymen in general usually use a saw because they are not continually working with wallboard.

While a knife does not create the dust condition that a saw does, it usually requires that the wallboard be marked and cut to measurement prior to nailing the wallboard to the wall studs. Where openings for windows, electrical outlets and the like are to be cut, this necessitates relatively accurate measurements from the edges of the wallboard, usually placing the wallboard horizontal while marking the areas to be cut. Now that wallboards frequently come in relatively large sizes (4 × 12 feet), two or three openings sometimes are needed in a single board. For example, one or two windows might be required plus one or two openings that must be in registry with an electrical outlet or two. If the measurements are not carefully made, then the opening will not be properly positioned or aligned when the wallboard is hung.

Further, when a hand saw or motor-driven saw is employed, a considerable amount of dust is created, the dustladen air making the environment objectionable and unhealthy to work in. Where a motor-driven saw is used, even the electric motor can become clogged with dust. Where remodeling is done, any furniture must be properly covered which is a nuisance to do.

SUMMARY OF THE INVENTION

One object of my invention is to provide a blade that will cut wallboard after it has been nailed or hung to the wall studs, thereby affording an appreciable saving in time because the opening to be formed need not be prelocated or at least not precisely so. Also, there will be less waste of material from breakage, for the wallboard is considerably more rigid prior to making openings therein; the openings weaken the panel and make it more vulnerable to breaking during the handling and nailing thereof. Even an uncut wallboard panel has considerably more rigidity when hung because of the added reinforcement provided by the anchoring thereof.

A very important object of my invention is to, for all intents and purposes, eliminate the creation of dust that normally results, particularly where a saw is used in the forming of the opening. Not only is it desirable to avoid contaminating the air with the particulate material from the sawing action but the lack of dust makes it much easier to see the pencil guidelines on the wallboard that have been made to show where the openings are to be located.

Another object is to provide a blade that will not injure or mutilate the paper on the finish side of the wallboard.

Still further, an object of the invention is to provide a blade that need not go completely through the paper so that the wallboard can be cut when it confronts studs, electrical outlet boxes, wiring that might be immediately behind the wallboard and not visible to the worker, and other obstructions that may be hidden behind the wallboard.

Briefly, my invention contemplates the use of a sabre saw for reciprocating a blade having a chisel point at the free end thereof which is formed by two inclined edges extending rearwardly at an acute angle, the endmost of these inclined edges repeatedly acting against the gypsum material to force it rearwardly into the kerf that has been cut. It is in no way necessary that the chisel point pass completely through the wallboard, for it need only fracture or weaken the paper on the rough side, the gypsum in this way being confined until the weakened line has been severed. Even when the chisel point passes completely through the wallboard, the camming action exerted against the gypsum does not cause any objectionable amount of gypsum to pass into the surrounding air. A cutting point severs the paper on the finish side of the wallboard, doing so in a manner such as not to mutilate the paper and thus destroy its aesthetic appearance. The blade during the cutting operation always acts in a direction away from the worker.

DESCRIPTION OF THE PREFERRED EMBODIMENT

Figure 4:
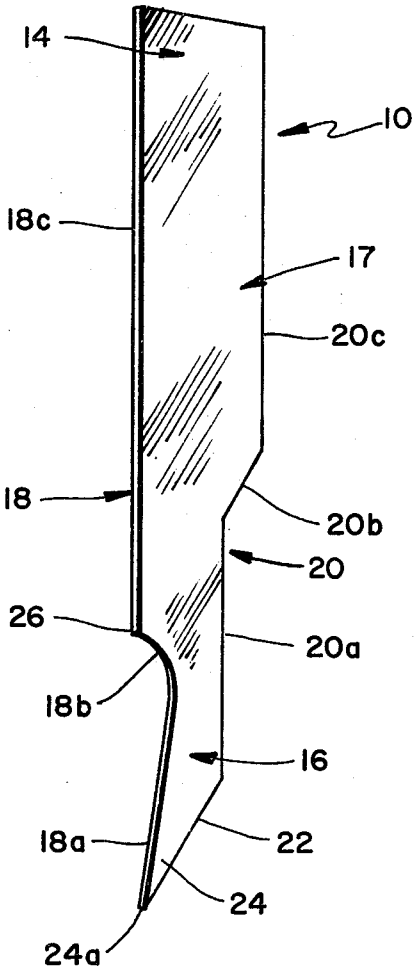
FIG. 4 is a perspective view of just the blade without the sabre saw being shown.

The blade exemplifying my invention has been denoted generally by the reference numeral 10. As the description progresses, it will be of benefit to refer to the longitudinal axis which has been labeled 12. The elongated blade (in the position appearing in FIGS. 2, 3 and 4) has an upper end and a lower end, these ends being identified generally by the reference numerals 14 and 16, respectively, plus an intermediate body 17. Stated somewhat differently, the end 16 constitutes a first end and the end 14 a second end. Additionally, the blade 10 has a first or forward edge 18, a second or rear edge 20 and a third or bottom edge 22. Still further, there is a tooth or chisel point 24 where the first or forward edge 18 meets the third or bottom edge 22 having a tip **24*a***.

At this stage, it will be of help, it is believed, to describe more fully the first or forward edge 18. In this regard, from FIG. 3 it will be discerned that a first portion **18*a*, which is substantially straight inclines from the third or bottom edge 22 toward the second or opposite end 14 of the blade 10 and also toward the longitudinal axis 12, that is, rearwardly toward the second edge 20, doing so relative to the edge 22 at an acute angle of approximately 40°. With respect to the path of intended travel or advancement, the third edge 22 makes an angle of approximately 50°. Hence, the first portion 18*a* is oriented at approximately 10° with the path of intended travel or advancement, which travel is along the axis 12**.

A second portion 18*b* of the first or forward edge 18 curves forwardly from the upper end of the first portion 18*a* after forming the chisel point 24 until it reaches a third portion 18*c*, the second and third portions 18*b* and 18*c*, respectively, forming an obtuse angle of approximately 100° and thereby providing a cutting point at 26. Stated somewhat differently, the first and second edge portions 18*a*, 18*b*, respectively, form a notch that is inset rearwardly or toward the axis 12 from the third edge portion 18*c*.

Still further, the dotted line projection of the third edge portion 18*c*, which spans both the first and second portions 18*a* and 18*b*, has been given the reference numeral 18*d*. Careful inspection of FIG. 3, and this feature is quite important, will reveal that the tip 24*a* of the chisel point 24 is spaced rearwardly or inset slightly toward the axis 12 from the projection line 18*d*, the increment being indicated by the letter x. Stated somewhat differently, the notch formed by the first and second edge portions 18*a* and 18*b* starts at a point with respect to the straight or third edge portion 18*c* such that the very tip 24*a* of the chisel point 24 is displaced from the projection line 18*d* by the distance labeled x. In other words, the point 26 always leads the tip 24*a* of the point 24. As will become evident during the operational description, this results in the cutting action being on the stroke away from the worker.

Describing now the second or rear edge 20, it will be perceived that there is a first portion 20*a*, which is straight, that extends from the third edge 22 toward the end 14 of the blade throughout a length greater than the sum of said first and second forward portions 18*a* and 18*b*, angling to form a second portion 20*b* and then proceeding in a straight direction once again to form a third portion denoted by the reference numeral 20*c*. Thus, the first and third edge portions 20*a* and 20*c* of the second edge 20 are parallel to the third edge portion 18*c* of the first edge 18 (and also to the longitudinal axis 12). By making the blade 10 somewhat narrower in a fore and aft direction, sharper cutting turns can be achieved. Here again, it is believed that this will become manifest during the ensuing operational description.

It should be recognized that the first, second and third edge 18, 20 and 22 are not knife edges, being blunt or flat from one side to the other side of the blade 10. This makes it such that my blade 10 can be easily and inexpensively fabricated.

Figure 3:
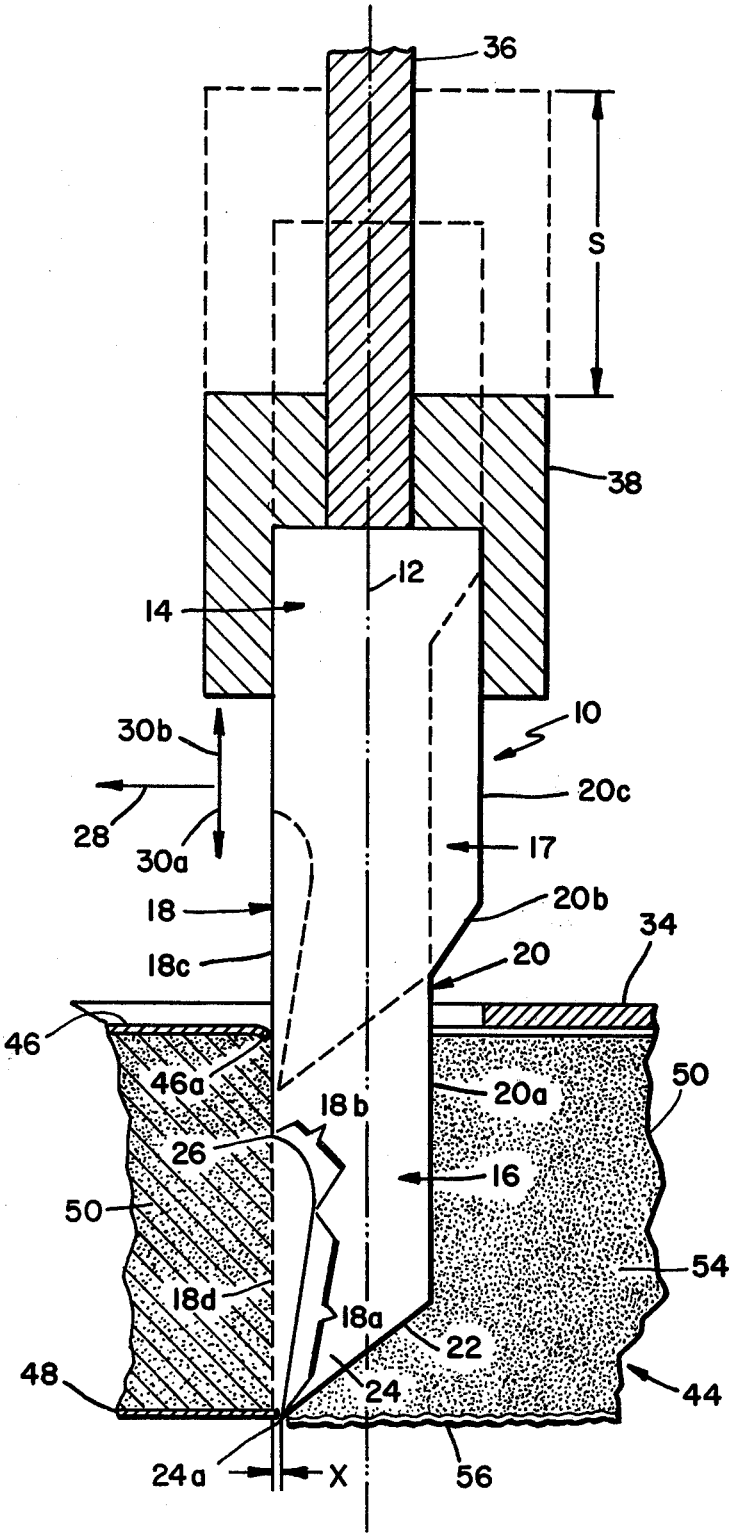
FIG. 3 is a sectional view taken in the direction of line 3—3 in FIG. 2, the solid line position of the blade depicting the chisel point at the advanced end of the sabre saw stroke and the dotted outline position depicting the blade at the retracted end of the stroke.

As a prelude for the operational description, attention is directed at this time to the arrow 28 in FIG. 3 which is intended to denote the forward advancement or travel of the blade 10 when being used. The double-headed arrow 30*a*, 30*b* indicates the reciprocation imparted to the blade 10 during use.

One nicety about the present invention is that the blade 10 can be used with a sabre saw 32 having the usual casing 33. As is conventional, the sabre saw 32 includes a base plate 34. Reciprocated by a motor, crank gear and crank pin (all contained within the casing 33 of the sabre saw 32) is a rod 36 that is rapidly reciprocated in opposite directions, that is, first in the direction 30*a* and then in the direction 30*b*. The rod 36 carries thereon a slotted holder 38, there being a recessed socket screw 40 for retaining the holder on the free end of the reciprocating rod 36. A slotted set screw 42 enables the upper end 14 (as viewed in FIGS. 2, 3 and 4) to be securely clamped within the slotted holder 38.

Figure 1:
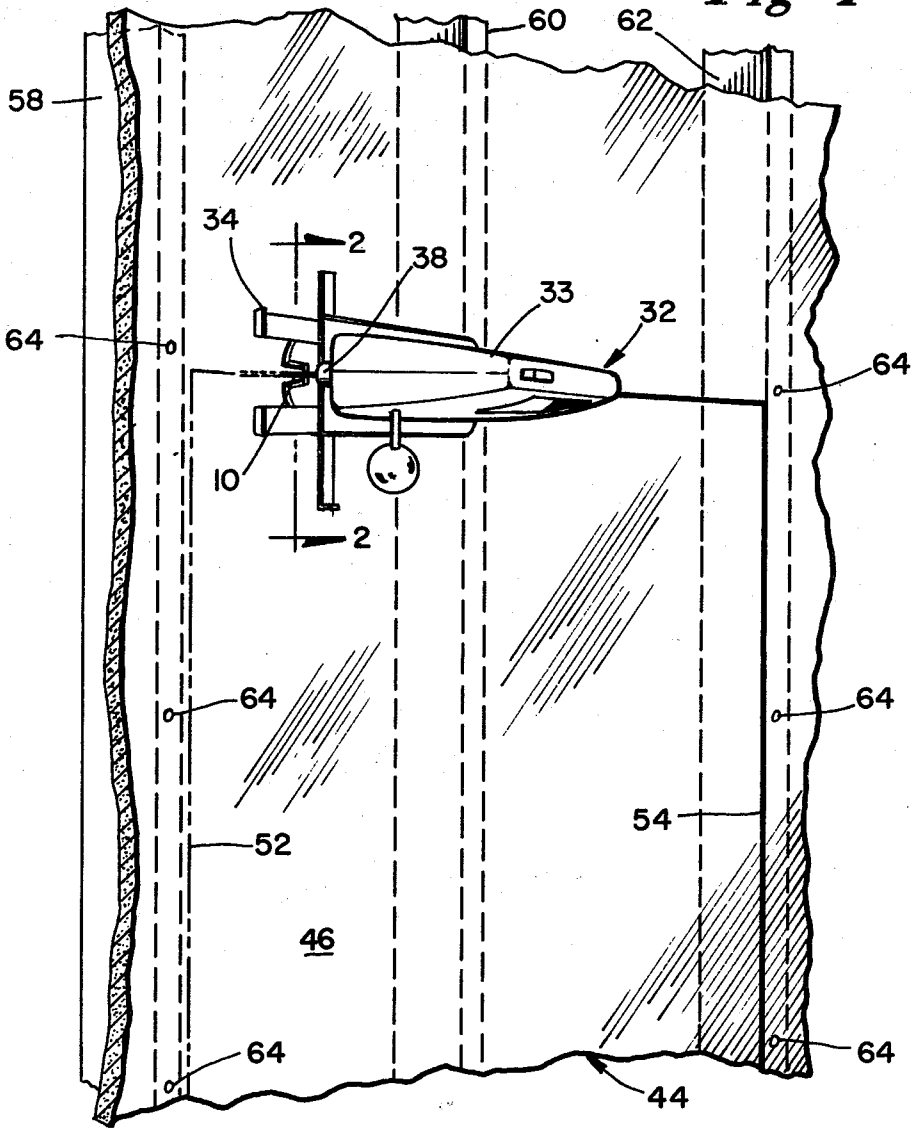
FIG. 1 is a perspective view showing a section of hung wallboard being cut when using a blade configured in accordance with my invention.

A typical section of wallboard 44 has been illustrated in FIG. 1. While the term commonly used is "wallboard", it is to be appreciated that it is sometimes called sheetrock, plasterboard or drywall. In any event, there is a first layer of heavy paper 46 on the finish side and a second layer of heavy paper 48 on the rough side, there being a gypsum core 50 sandwiched therebetween. It is the powder-like composition of the core 50 that presents a highly objectionable dust problem. However, my invention avoids the creation of dust when cutting an opening in the wallboard 44.

It may be helpful to allude to the pencil guideline 52 and the kerf 54 in FIG. 1, the blade 10 simply following the pencil guideline 52 when cutting the kerf 54. Because no objectionable dust is created, the guideline is always visible, which is not the case when using a saw. Also, as can be seen in FIG. 3, the paper 48 on the rough side is not completely severed, but only weakened by reason of the ripple-like effect labeled 56.

For the sake of an exemplary completeness, three studs 58, 60 and 62 have been pictured in FIG. 1. Any number of nails 64 are used in hanging the wallboard 44, only a fragmentary portion thereof appearing in FIG. 1. It will be understood that the wallboard 44 is usually sold in 4 × 12 feet panels.

OPERATION

For the sake of description, it will be assumed that the opening to be cut resides between the vertical studs 58 and 62. Although the stud 60 would not normally extend down to where the opening is to be cut, if facilitates the description to assume that it does in order to provide what would normally constitute an interferring obstruction. In actual practice, the window opening would be framed and the studs 58 and 62 would be to either of the opening and the stud 60 would terminate at the top and bottom of the opening. In the pictured instance, the kerf 54 appears to the right in FIG. 1 and substantially halfway across the upper portion of this figure. Owing to the reduction in blade width realized by the angled edge portion 20*b*, the cutting end 16 can negotiate relatively sharp turns as should be readily apparent from the path traversed in going from a vertical direction to a horizontal one across the upper portion of FIG. 1.

Viewing FIG. 3, it is believed evident that the blade 10 is rapidly reciprocated by the sabre saw 32, the stroke being indicated by the letter s. The stroke also is the distance between the solid line position of the chisel point 24 and the dotted line position thereabove. It will be perceived that the chisel point 24, when moving to its dotted position, does not pass sufficiently upwardly so as to move beyond the finish paper 46. If the wallboard 44 is thinner than that shown, then the chisel point 24 might very well on the return stroke move through the paper 46 but this does not in any way adversely affect the cutting action. It is necessary, though, for the cutting point 26 to move from within the wallboard 44 to a position on the worker's side of the finish paper 46. In this instance, it is believed obvious that the solid line position of the cutting point 26 is within the core 50, whereas the dotted line position thereof is completely out of the core 50.

Figure 2:
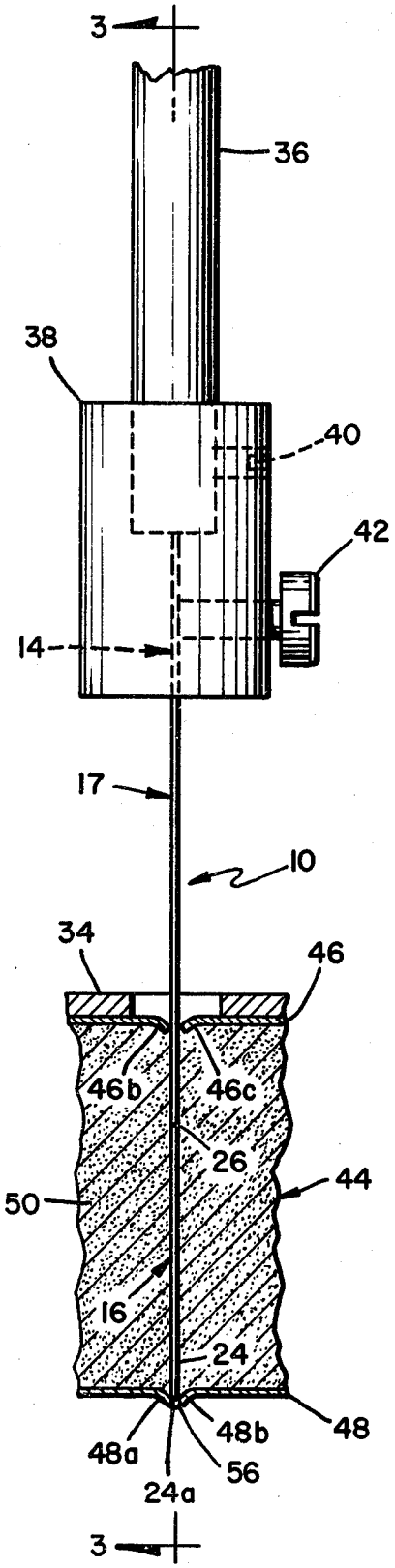
FIG. 2 is a sectional view through the wallboard taken in the direction of line 2—2 in FIG. 1.

Consequently, on the down stroke, "down" being only relative but appearing this way in FIGS. 2 and 3, the tip 24*a* of the chisel point 24 on the first stroke (when not starting from an outside edge of the wallboard 44) pierces the paper 46 followed as the "down"

stroke continues by the cutting point 26 passing through the paper 46 somewhat farther in advance of the entering position of the chisel point 24. In other words, after the initial entry of the chisel point 24 into the core 50, thereafter the cutting point 26 leads the tip 24*a* of the chisel point by the incremental distance x (FIG. 3). This produces a rounded deflection of the paper 46 ahead of the blade 10 which has been given the reference numeral 46*a*. Likewise, the paper 46 to either side of the blade 10, as viewed in FIG. 2, is also rounded, these rounded portions of the paper 46 having been given the reference numerals 46*b* and 46*c*. The rounded portions imparted to the rough paper 48, as seen in FIG. 2, have been given the reference numerals 48*a* and 48*b*. As already explained, the rough paper 48 need not be severed, for the rippled effect labeled 56, this being the portion beneath the blade 10 in FIG. 2, can be merely pierced or punctured at spaced intervals as the blade 10 is advanced in the direction of the arrow 28. This has the decided advantage of permitting the wallboard 44 to be cut for all intents and purposes, yet not causing the chisel point 24 to strike any object that may be on the far side of the wallboard 44, that is, confronting the paper 48, when the cut is being made in wallboard that has already been hung, as it is in FIG. 1. Consequently, when the sabre saw 32 and the blade 10 pass the stud 60 (which in office buildings may be metal), there is no interference to the continued making of the kerf 54, for the tip 24*a* of the chisel point 24 simply "bumps" against the edge of the stud 60 as it passes thereover. This advantage is of appreciable importance when some metallic object is encountered, such as a metal stud, an electrical outlet box or wiring if already existing wallboard is being cut during a remodeling job. Even though the rippled effect 56, which is only a fracturing of the paper 48, is not completely severed, it permits easy removal of the cutout section of the wallboard 44 after the kerf 54 has been made throughout the rectangle that is to constitute the window opening.

As the blade 10 moves in the direction of the arrow 30*a*, it follows that not only is the paper 46 severed by the cutting point 26, but the chisel point 24, more specifically its tip 24*a*, literally scrapes away some of the gypsum constituting the core 50, forcing the dislodged gypsum in a direction toward the rough paper side 48 and rearwardly into the open slit constituting the kerf 54. Even though the chisel point 24 is not completely retracted, this being when the blade 10 is moved in the direction of the arrow 30*b*, from the wallboard 44, it follows that only a small amount of wallboard need be acted on by the cutting point 26 when the next stroke occurs which will be in the direction of the arrow 30*a*. Whatever small amount of gypsum that is dislodged each time by the point 26 is in each instance pressed into the kerf 54. The feature to be appreciated is that there is never any pulling of the gypsum or the finish paper 46 toward the worker, that is in the direction of the arrow 30*b*. This avoids having the powdered gypusm 50 kicked into the air in the direction of the workman manipulating the sabre saw 32. Not only does this make it such that the workman breathes clean air, but it prevents dust from getting into the sabre saw 32. Also, it eliminates the need for covering furniture during a remodeling job.

Since the point 26 pushes against the paper 46, it is smoothly severed as is believed evident by the depicted rounded portions 46*a*, 46*b* and 46*c*. Consequently, the displacing of the tip of the chisel point 24 rearwardly from the cutting point 26, as denoted by x in FIG. 3, is quite important in realizing all of the advantages of my invention. This is all in addition to the savings in time as far as laying out prospective openings prior to the hanging of wallboard. Still further, it will be recognized that if a number of openings are to be made in a wallboard panel that it is appreciably weakened and is vulnerable to breakage during the subsequent hanging.

I claim:

1. A blade for cutting comprising an elongated flat body having smooth first and second ends, smooth first and second spaced edges plus a smooth third edge at said first end extending toward said second end and to said second edge, said first edge having a first portion thereof extending from said third edge toward said second end and toward said second edge to form a chisel point at said first end, the sides of said body being generally parallel at said second end and said first and third edges being blunt or flat between said generally parallel sides.

2. A blade in accordance with claim 1 in which said first edge has a second portion forming a continuation of said first portion, which extends toward said second end and away from said second edge.

3. A blade in accordance with claim 2 in which said first edge has a third portion forming a continuation of said second portion, said third portion being straight and parallel to a first portion of said second edge.

4. A blade in accordance with claim 3 in which said blade has a longitudinal axis along which it is intended to be reciprocated, the tip of said chisel point being nearer said longitudinal axis than is said third edge portion.

5. A blade in accordance with claim 4 in which the juncture of said first and second edge portions of said first edge is nearer said axis than the tip of said chisel point.

6. A blade in accordance with claim 5 in which said first portion of said second edge extends from said third edge a greater distance than the sum of said first and second portions of said first edge.

7. A blade in accordance with claim 6 in which said second edge has second and third portions, said second portion of said second edge extending toward said second end and away from the third portion of said first edge.

8. A blade in accordance with claim 7 in which the third portion of said second edge extends from the second portion of said second edge toward said second end in a parallel relation to the third portion of said first edge.

9. A blade in accordance with claim 2 in which the first portion of said first edge is straight and the second portion thereof is curved.

10. A blade in accordance with claim 1 in which the distance between said first and second edges is less at said first end than at said second end.

11. The combination with a sabre saw including a reciprocal blade holder, an elongated blade comprising an end portion held by said holder and a cutting end portion having a chisel point, said cutting end portion being formed by a smooth forward edge and smooth end edge, said forward and end edges extending at an acute angle with respect to each other and being blunt or flat from one side of said cutting end portion to the other side thereof to form said chisel point.

12. The combination set forth in claim 11 in which said forward edge curves forwardly after forming said chisel point and then extends in a straight line, the curved and straight portions of said forward edge forming an obtuse angle and thus a cutting point spaced from said chisel point.

13. The combination set forth in claim 12 in which the tip of said chisel point is disposed slightly rearwardly of said cutting point.

14. The combination set forth in claim 13 in which the stroke of said reciprocal blade holder is less than the thickness of the wallboard to be cut and said cutting point is spaced from said chisel point a distance less than the thickness of said wallboard.

* * * * *